US012661708B2

(12) United States Patent
Nuka et al.

(10) Patent No.: US 12,661,708 B2
(45) Date of Patent: Jun. 23, 2026

(54) METHOD FOR MANUFACTURING CONSTANT VELOCITY DRIVE SHAFT

(71) Applicant: SIGMA & HEARTS CO., LTD, Samutprakan (TH)

(72) Inventors: Motoharu Nuka, Samutprakan (TH); Smit Jaradswong, Chonburi (TH); Tsuyoshi Muramatsu, Kyoto (JP); Munemasa Kamizaiku, Shiga (JP)

(73) Assignee: SIGMA & HEARTS CO., LTD, Samutprakan (TH)

( * ) Notice: Subject to any disclaimer, the term of this patent is extended or adjusted under 35 U.S.C. 154(b) by 290 days.

(21) Appl. No.: 18/473,490

(22) Filed: Sep. 25, 2023

(65) Prior Publication Data

US 2024/0316618 A1 Sep. 26, 2024

(30) Foreign Application Priority Data

Mar. 23, 2023 (JP) ..... 2023-047257

(51) Int. Cl.

| | |
|---|---|
| ***B21K 1/00*** | (2006.01) |
| ***B21J 5/08*** | (2006.01) |
| ***B21K 1/06*** | (2006.01) |

(52) U.S. Cl.

CPC .. *B21K 1/06* (2013.01); *B21J 5/08* (2013.01)

(58) Field of Classification Search

CPC ..... B21J 5/08; B21K 1/06; B21K 1/12

See application file for complete search history.

(56) References Cited

U.S. PATENT DOCUMENTS

2008/0060406 A1* 3/2008 Yamanaka ..... B21D 53/845 29/888.1
2018/0318910 A1* 11/2018 Yoshida ..... B21K 1/063

FOREIGN PATENT DOCUMENTS

EP 3915695 A1 * 12/2021 ..... B21J 9/022
JP 07-012115 1/1995

* cited by examiner

*Primary Examiner* — Debra M Sullivan
(74) *Attorney, Agent, or Firm* — ODEDRA IP, PLLC

(57) ABSTRACT

The prevent invention proposes to provide a method for manufacturing a constant velocity drive shaft, which can manufacture especially a constant velocity drive shaft among other drive shafts with efficiency and stable high accuracy. The method for manufacturing a constant velocity drive shaft using a closed cold forging device having a plurality of mold pairs structured with an upper mold and a lower mold, comprises a first process for processing a forming material for forming the constant velocity drive shaft to form a first forming material having first large diameter portions by applying a pressure from a first upper mold of a first mold pair and pressures from both sides of the forming material, a second process for forming a second forming material having second large diameter portions by applying a pressure from a second upper mold of a second mold pair and pressures from both sides of the first forming material with respect to the first forming material being mold-processed in the first process, and a third process for forming third large diameter portions by applying a pressure from a third upper mold of a third mold pair and pressures from both sides of the second forming material with respect to the second forming material being mold-processed in the second process.

4 Claims, 11 Drawing Sheets

METHOD FOR MANUFACTURING CONSTANT VELOCITY DRIVE SHAFT

CROSS-REFERENCE TO RELATED APPLICATIONS

This application is based upon and claims the benefit of priority from the prior Japanese Patent Applications No. 2023-047257, filed on Mar. 23, 2023, the entire contents of which are incorporated herein by reference.

BACKGROUND OF THE DISCLOSURE

1. Field of the Disclosure

The present disclosure relates to a method for manufacturing a constant velocity drive shaft for a vehicle by closed cold forging.

2. Description of the Related Art

Conventionally, a shaft for a vehicle is used for a part of power transmission passes from an engine, and transmits revolving movement of the engine to drive wheels, and so forth, as rotation drive force. As for the shaft, weight saving is required for improving fuel efficiency of vehicle, and high stiffening is required for improving quietness by reducing vibration.

In the method for manufacturing a shaft for a vehicle, the shaft is generally manufactured by machining such as cutting, or the like.

Therefore, in Japanese Unexamined Patent Application Publication No. Hei 7-12115 (hereinafter to be referred to as Patent Literature 1), as a method for manufacturing a shaft for a vehicle without cutting materials, a manufacturing method with cold forging is proposed.

According to Patent Literature 1, it is described that a block-like base which is connected to a driving part of a window regulator, a cylindrical shaft which is arranged perpendicular to the base and continued from the base, and a width across flat formed on the end of the shaft are integrally formed, an inner diameter bearing is arranged inside the width across flat and coaxially with the shaft, and these components are prepared by a cold forging method.

However, in the case of the drive shaft prepared by the cold forging method described in Patent Literature 1, it is difficult to avoid formation of burrs at processing parts, and therefore, there is a problem that a process of removing the burrs decreases efficiency on the manufacturing of the drive shaft and also increases manufacturing costs.

The prevent disclosure has been made in view of such problems, and proposes to provide a method for manufacturing a constant velocity drive shaft, which can manufacture especially a constant velocity drive shaft among other drive shafts with efficiency and stable high accuracy.

BRIEF SUMMARY OF THE DISCLOSURE

In accordance with one aspect of the present disclosure, a method for manufacturing a constant velocity drive shaft using a closed cold forging device having a plurality of mold pairs structured with an upper mold and a lower mold, comprises a first process for processing a forming material for forming the constant velocity drive shaft to form a first forming material having first large diameter portions by applying a pressure from a first upper mold of a first mold pair and pressures from both sides of the forming material, a second process for forming a second forming material having second large diameter portions by applying a pressure from a second upper mold of a second mold pair and pressures from both sides of the first forming material with respect to the first forming material being mold-processed in the first process, and a third process for forming third large diameter portions by applying a pressure from a third upper mold of a third mold pair and pressures from both sides of the second forming material with respect to the second forming material being mold-processed in the second process.

Moreover, in the method for manufacturing the constant velocity drive shaft according to the present disclosure, the first mold pair has first cavities for forming the first large diameter portions, and both sides of a concave shape structuring the first cavity has a tapered shape.

In the method for manufacturing the constant velocity drive shaft according to the present disclosure, the second mold pair has second cavities for forming the second large diameter portions, and first cavities for maintaining the shapes of the first large diameter portions contained in the first forming material, and both sides of a concave shape structuring the second cavity has a tapered shape.

In the method for manufacturing the constant velocity drive shaft according to the present disclosure, the third mold pair has third cavities for forming the third large diameter portions, and first cavities and second cavities for maintaining the shapes of the first large diameter portions and the second large diameter portions contained in the second forming material, and the third cavity has a tapered shape only on one side of the concave shape.

In the method for manufacturing the constant velocity drive shaft according to the present disclosure, in the first process to third process, each respective forming material is pressed by each respective upper mold and is pressed from both sides in the axial direction of the forming material.

According to the present disclosure, a plurality of pairs of molds having different shapes are used to perform press forming by closed cold forging in each process, thereby preventing the occurrence of burrs, reducing costs, and enabling to manufacture a constant velocity driving shaft of high-precision.

These and other objects, features, aspects, and advantages of the present disclosure will become apparent to those skilled in the art from the following detailed description, which, taken in conjunction with the annexed drawings, discloses preferred embodiments of the present disclosure.

DESCRIPTION OF THE PREFERRED EMBODIMENTS

Next, a method for manufacturing a drive shaft according to the present disclosure will be described with reference to the drawings.

Figure 1:
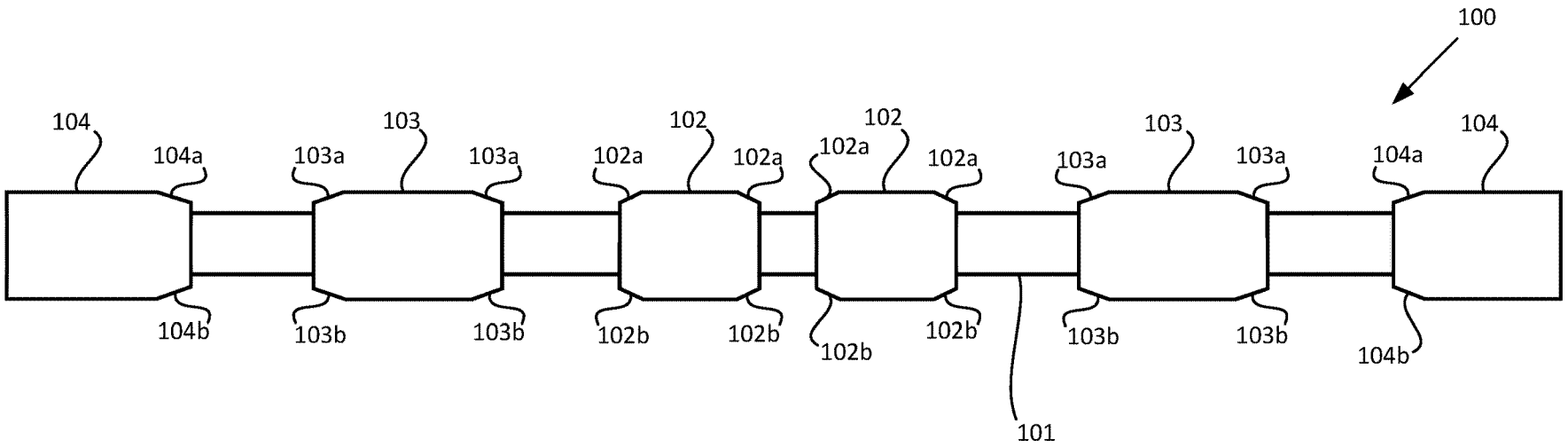
FIG. 1 is a plan view showing a structure of a constant velocity drive shaft manufactured according to the present disclosure.

FIG. 1 is a plan view showing the configuration of a drive shaft manufactured according to the present disclosure.

As shown in FIG. 1, a constant velocity drive shaft 100 manufactured by the constant velocity drive shaft manufacturing method of the present disclosure generally includes a pair of constant velocity universal joints spaced apart in the axial direction, and an intermediate shaft that is provided between both constant velocity universal joints, the intermediate shaft meant to be rotating integrally with inner joint members of both of the constant velocity universal joints, and is structured with a shaft portion 101, first large-diameter portions 102, second large-diameter portions 103, and third large diameter portions 104, which are formed from the center of the shaft portion 101 toward respective ends in the axial direction. The constant velocity drive shaft 100 is manufactured by processing a solid rod-shaped material, and the shaft portion 101, the first large diameter portions 102, the second large diameter portions 103, and the third large diameter portions 104 are shaped with closed cold forging.

The shaft portion 101 has a diameter that is the same as or slightly smaller than the diameter of the solid rod-shaped raw material of the constant velocity drive shaft 100 before shaped.

The first large diameter portions 102 are formed near the center of the constant velocity drive shaft 100 by closed cold forging. The first large diameter portion 102 has a cylindrical shape with a diameter that is larger than that of the shaft portion 101 and has tapered portions 102*a* and 102*b* at both upper and lower ends.

The second large diameter portion 103 has a cylindrical shape with a diameter that is substantially the same as that of the first large diameter portion 102 and has tapered portions 103*a* and 103*b* at both upper and lower ends. The third large diameter portions 104 are formed at both ends of the constant velocity drive shaft 100 and have a diameter that is larger than that of the shaft portion 101 and approximately the same as that of the first large diameter portion 102 and the second large diameter portion 103. The third large diameter portion 104 has a cylindrical shape, and has tapered portions 104*a* and 104*b* at end portions on the center side of the constant-velocity drive shaft 100.

<Regarding Configuration of Mold>

Next, molds that are used to manufacture the constant velocity drive shaft will be described.

Figure 2:
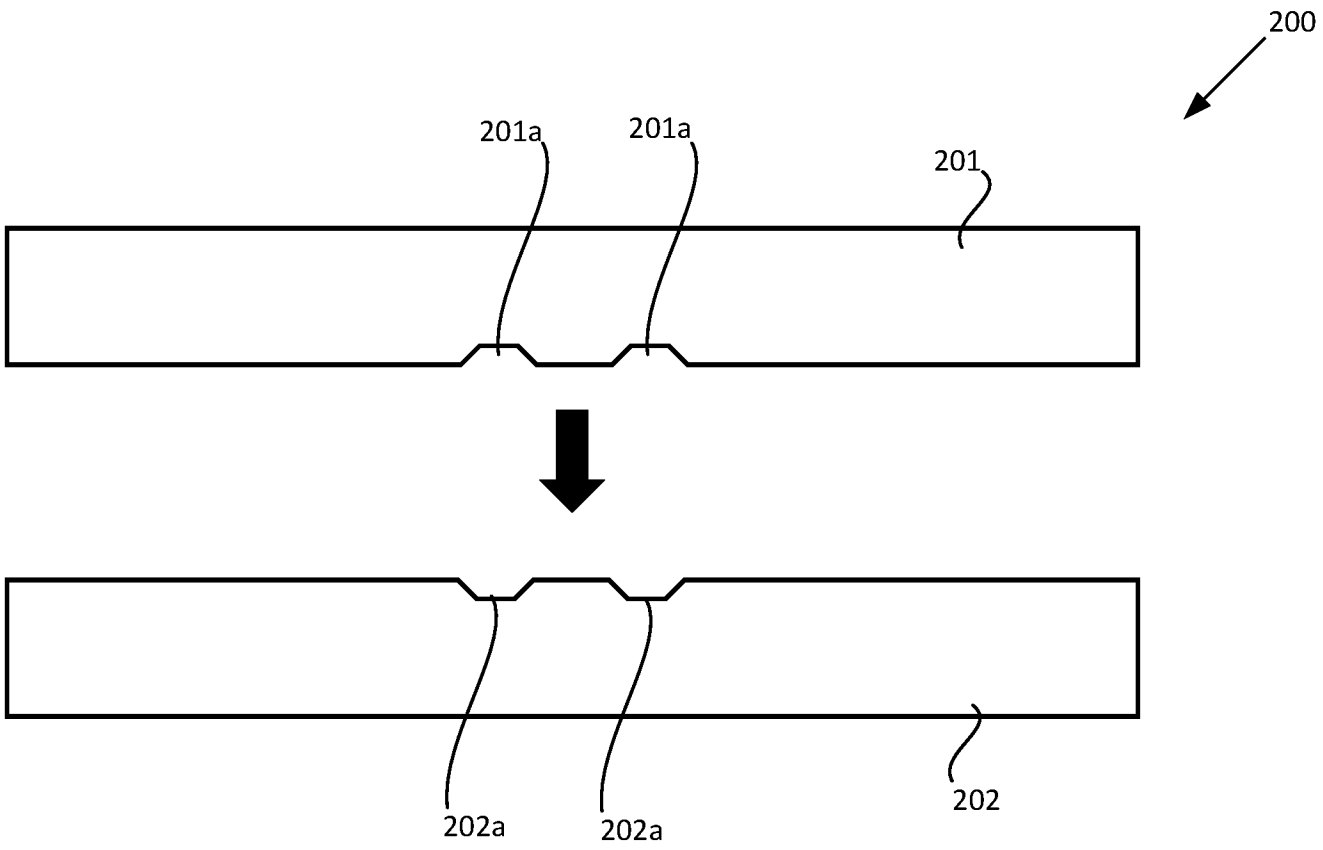
FIG. 2 is a figure showing a structure of a first mold.

FIG. 2 is a diagram showing a structure of a first mold.

As illustrated, the first mold 200 is structured with a first upper mold 201 and a first lower mold 202. The first mold 200 is for forming the first large-diameter portion 102 that constitutes the constant-velocity drive shaft 100, and the first upper mold 201 and the first lower mold 202 have respective pairs of concave first cavities 201*a* and 202*a* being formed.

The first cavities 201*a* and 202*a* are for forming the first large diameter portion 102 of the constant velocity drive shaft 100, and both sides of the concave shape of the first cavities 201*a* and 202*a* are tapered. The first upper mold 201 is of a vertically movable type, and the first lower mold 202 is of a fixed type, while the two are arranged so as to face each other.

Figure 3:
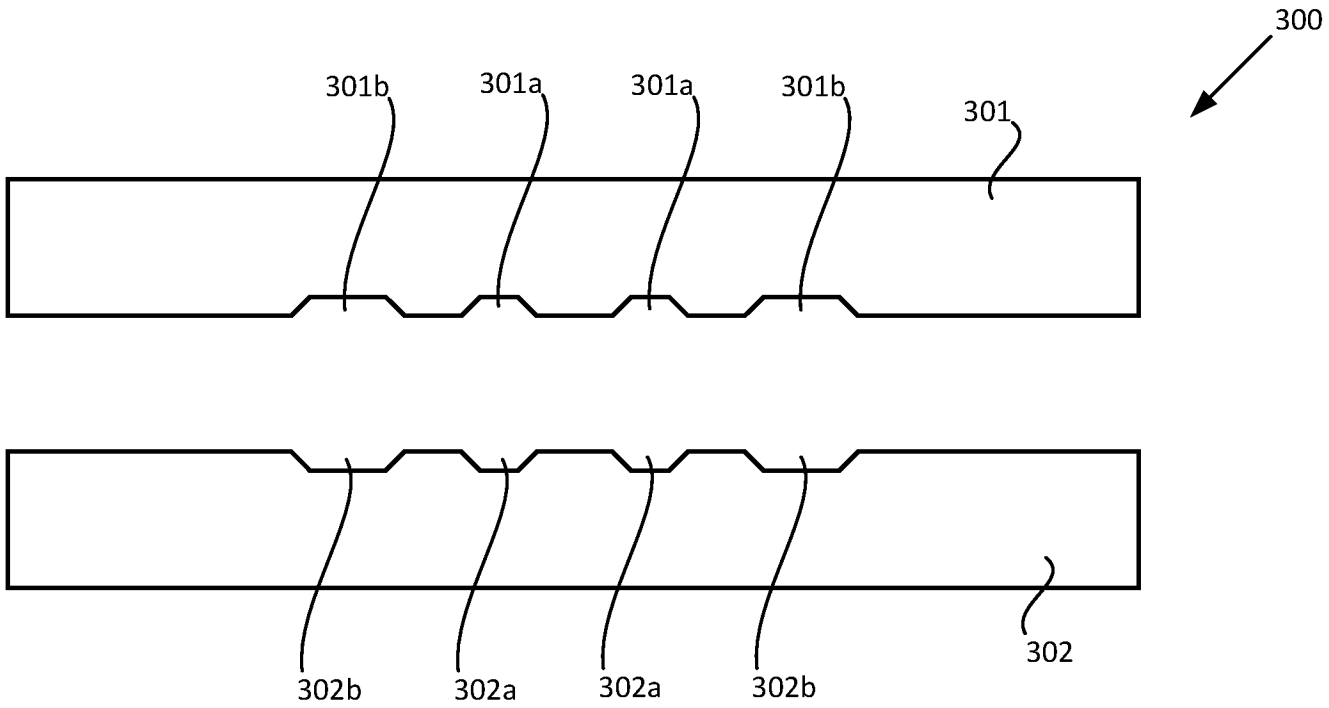
FIG. 3 is a figure showing a structure of a second mold.

FIG. 3 is a diagram showing a structure of a second mold.

As illustrated, the second mold 300 is structured with a second upper mold 301 and a second lower mold 302. The second mold 300 is for molding the second large diameter portion 103 of the constant velocity drive shaft 100, and the second upper mold 301 has a pair of concave first cavities 301*a* and a pair of concave second cavities 301*b* being formed, whereas the second lower mold 302 is similarly formed with a pair of first cavities 302*a* and a pair of second cavities 302*b*. The second upper mold 301 is of a vertically movable type, and the second lower mold 302 is of a fixed type, while the two are arranged so as to face each other.

The first cavities 301*a* and 302*a* formed in the second upper mold 301 and the second lower mold 302 are meant for maintaining the shape of the already formed first large diameter portion 102 at the time of forming the second large diameter portion 103, and they have shapes that are the same as the first cavities 201*a* and 202*a* formed in the first mold 200. Moreover, the second cavities 301*b* and 302*b* are meant for forming the second large diameter portion 103, and have tapered shapes on both sides of the concave shape.

Figure 4:
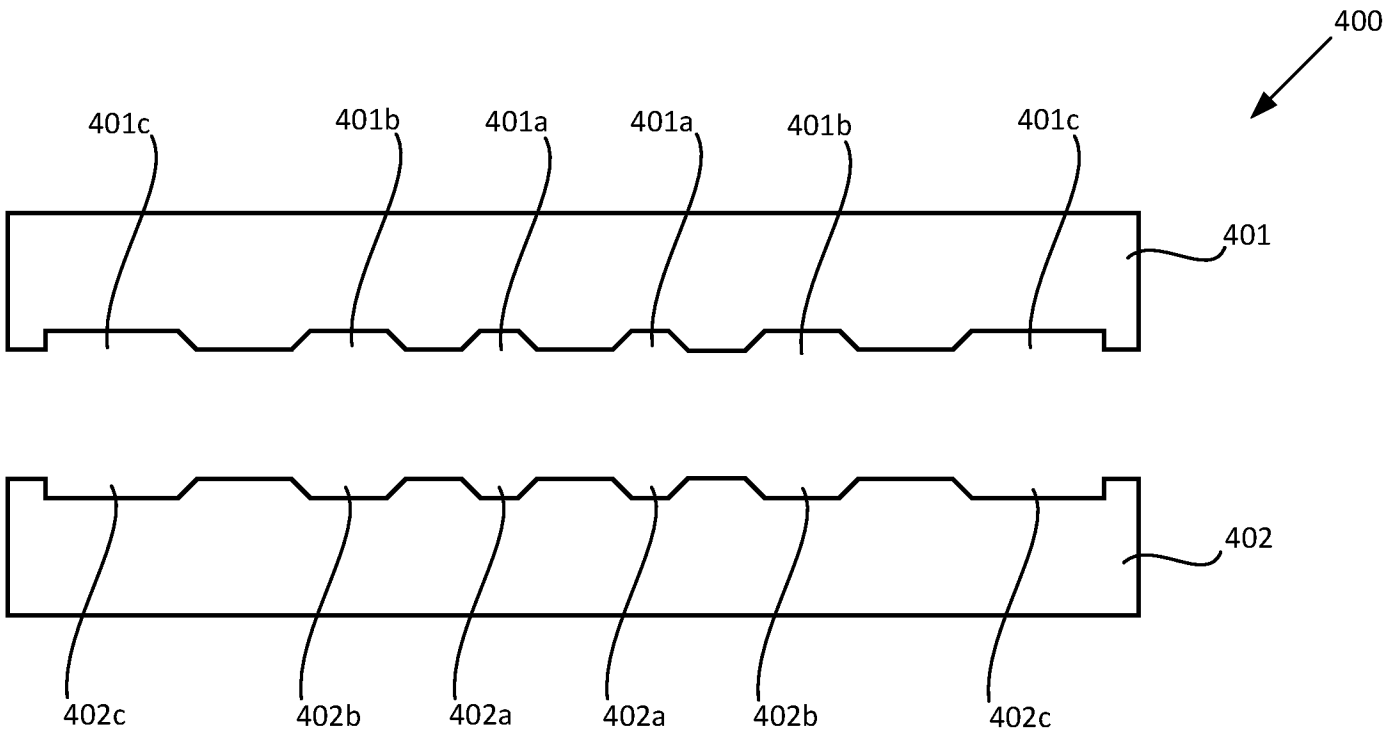
FIG. 4 is a figure showing a structure of a third mold.

FIG. 4 is a diagram showing a structure of a third mold.

As illustrated, the third mold 400 is structured with a third upper mold 401 and a second lower mold 402. The third mold 400 is for forming the third large diameter portion 104 of the constant velocity drive shaft 100, and the third upper mold 401 for forming the third large diameter portion 104 has third cavities 401*c* being formed while the third lower mold 402 has third cavities 402*c* being formed. The third cavities 401*c* and 402*c* are concave and tapered on one side. The third upper mold 401 is of a vertically movable type, and the third lower mold 402 is of a fixed type, while the two are arranged so as to face each other.

The first cavities 401*a* and 402*a*, and the second cavities 401*b* and 402*b* are formed in the third upper mold 401 and the third lower mold 402 for maintaining the shapes of the already formed first large diameter portion 102 and second large diameter portion 103 of the constant velocity drive shaft.

The first cavities 401*a* and 402*a* have the same shape as the first cavities 201*a* and 202*a* formed in the first mold 200, and the second cavities 401*b* and 402*b* have the same shape as the second cavities 301*b* and 302*b* formed in the second mold 300.

The cavities formed in each mold have a substantially trapezoidal shape, and both sides or one side thereof is tapered at an arbitrary angle.

A mechanism for lifting and lowering the first upper mold 201, the second upper mold 301, and the third upper mold 401 can be realized by, for example, a hydraulic mechanism or a gas pressure mechanism.

Next, a method for manufacturing a constant velocity drive shaft will be described with reference FIG. 5 to FIG. 11.

Figure 5:
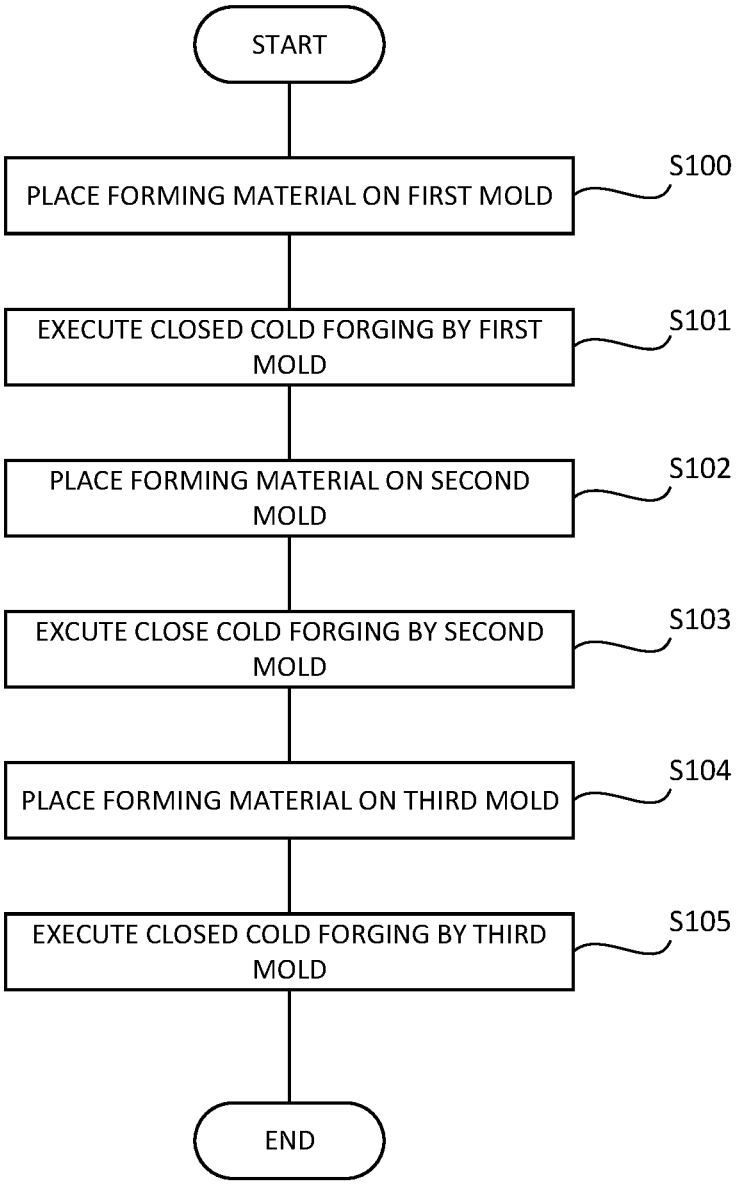
FIG. 5 is a flow chart showing a manufacturing process of the constant velocity drive shaft.

FIG. 5 is a flow chart for explaining a flow of the method for manufacturing the constant velocity drive shaft, FIGS. 6A and 6B and FIGS. 7A and 7B are diagrams showing a forming process of the first large-diameter portion of the constant velocity drive shaft with the first mold, and FIGS. 8A and 8B and FIGS. 9A and 9B are diagrams showing a forming process of the second large diameter portion of the constant velocity drive shaft with the second mold, and FIGS. 10A and 10B and FIGS. 11A and 11B are diagrams showing a forming process of the third large diameter portion of the constant velocity drive shaft with the third mold.

In the method for manufacturing the constant velocity drive shaft according to the present embodiment, the constant velocity drive shaft is manufactured step by step by closed cold forging using a plurality of molds.

First, a forming material X is placed on the first lower mold 202 of the first mold 200 (step S100). This forming material X is a solid rod-shaped material such as SCM435 (chromium molybdenum steel), which is a kind of steel for alloy and machine structural use.

Figure 6A:
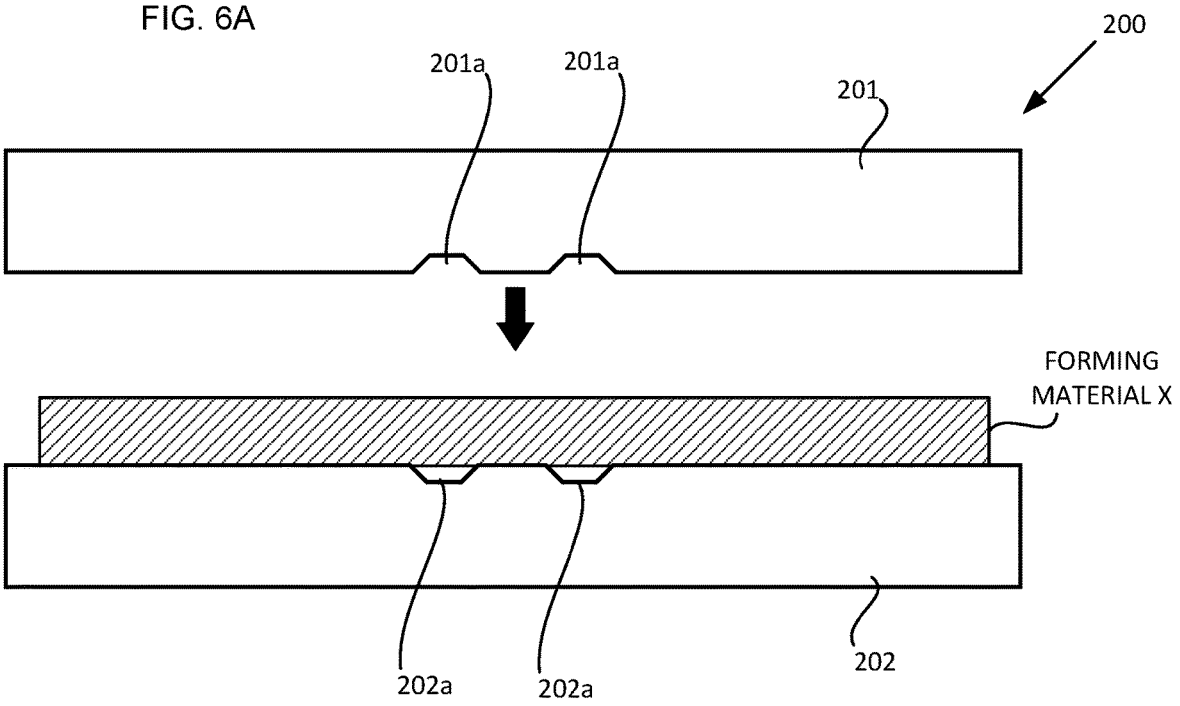
FIGS. 6A and 6B are diagrams showing forming processes of first large diameter portions by the first mold.
Figure 6B:
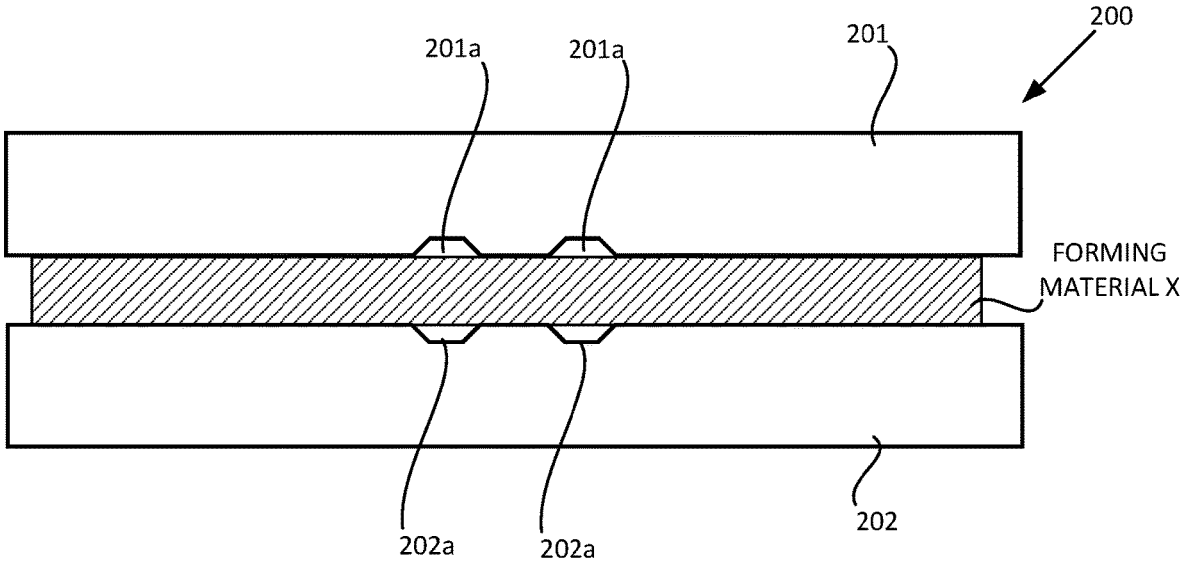
Figure 7A:
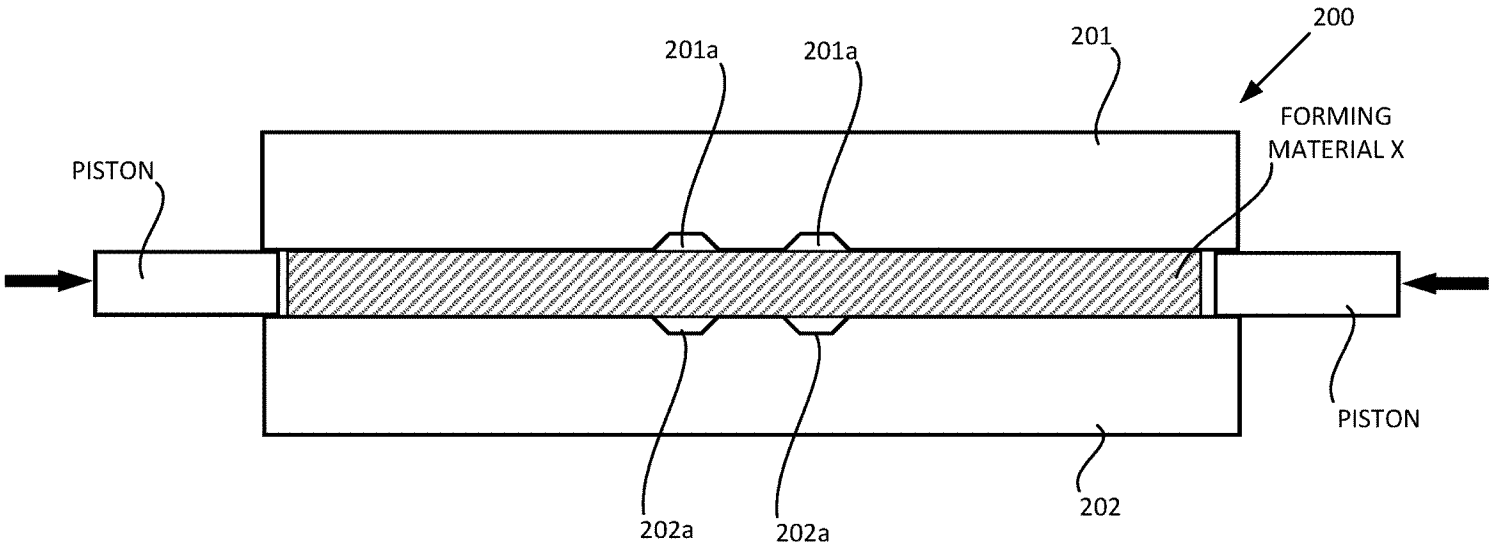
FIGS. 7A and 7B are diagrams showing forming processes of the first large diameter portions by the first mold.

As shown in FIG. 6A, the forming material X is placed on the first lower mold 202 of the first mold 200, and the first upper mold 201 is lowered by a hydraulic cylinder (not shown). Next, as shown in FIG. 6B, the first upper mold 201 is brought into close contact with the forming material X to form a closed state. While maintaining this closed state, the first upper mold 201 applies a predetermined load to the forming material X, and as shown in FIG. 7A, pressure is applied to the forming material X from both sides in the axial direction of the forming material X by pistons.

The downward load applied to the forming material X by the first upper mold 201 is 2000 kN to 5000 kN, and the load applied to the forming material X in the axial direction by the pistons is 2000 kN to 3000 kN.

Figure 7B:
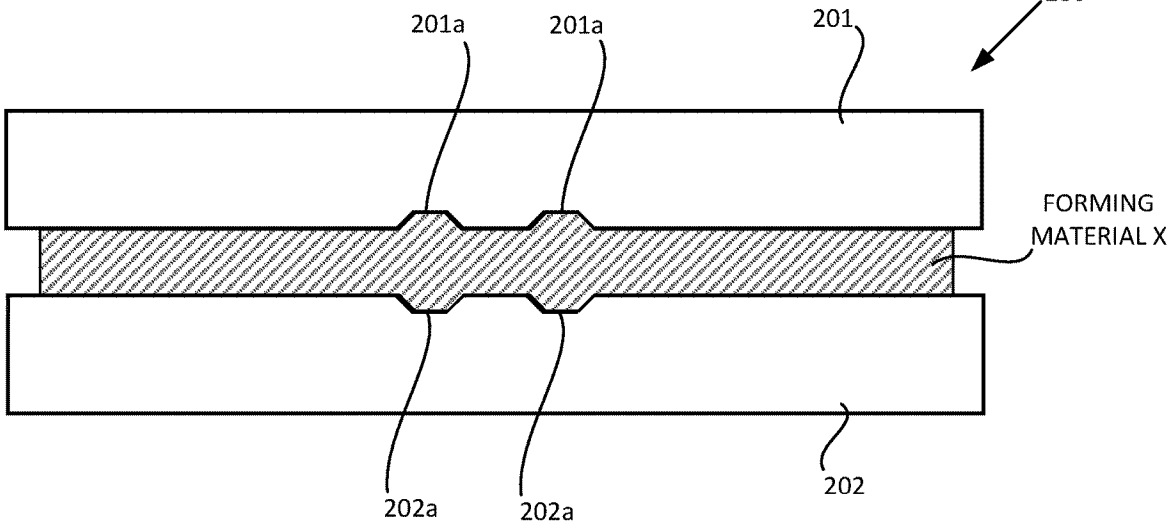

As shown in FIG. 7B, by the load of the first upper mold 201 and the load of the pistons, part of the forming material X flows into the concave portions that constitute the first cavities 201*a* formed in the first upper mold 201 and the first cavities 202*a* formed in the first lower mold 202, through extrusion molding, by which the first large diameter portions 102 are formed (step S101).

Figure 8A:
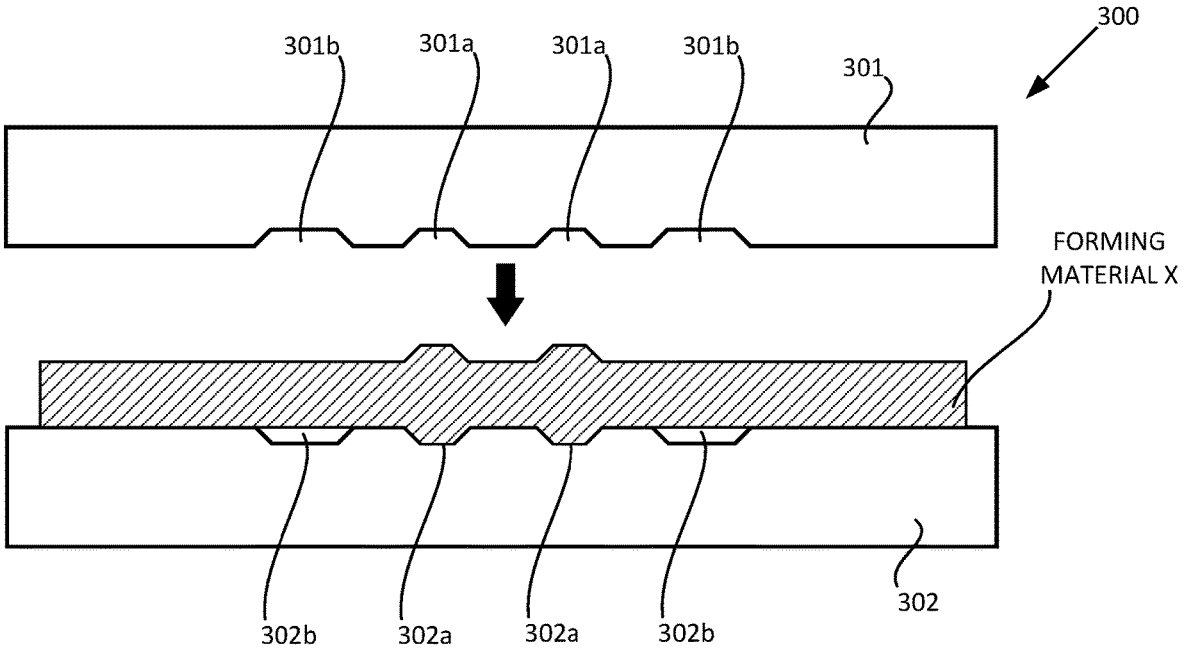
FIGS. 8A and 8B are diagrams showing forming processes of second large diameter portions by the second mold.
Figure 8B:
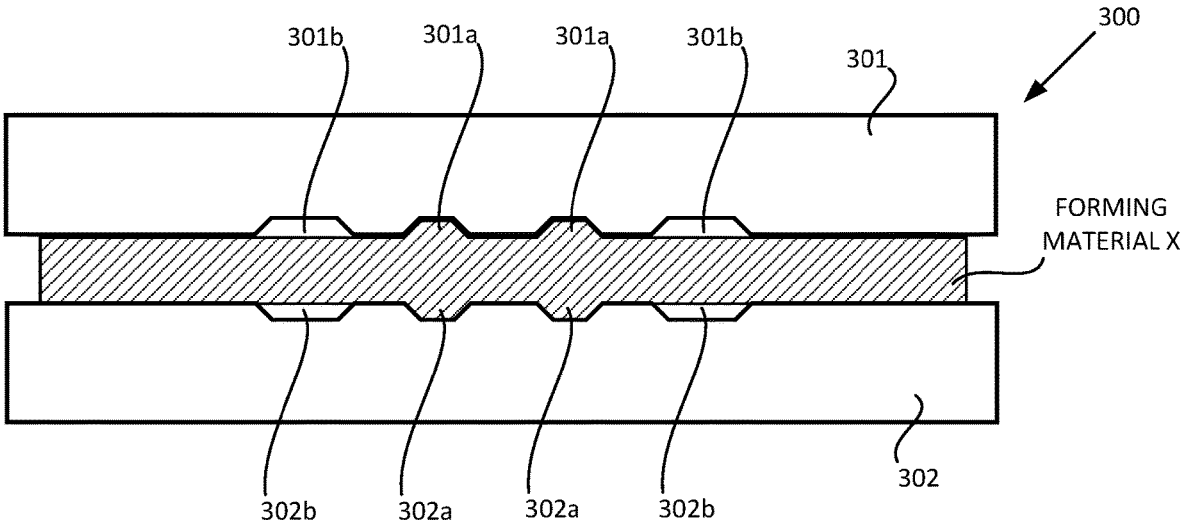
Figure 9A:
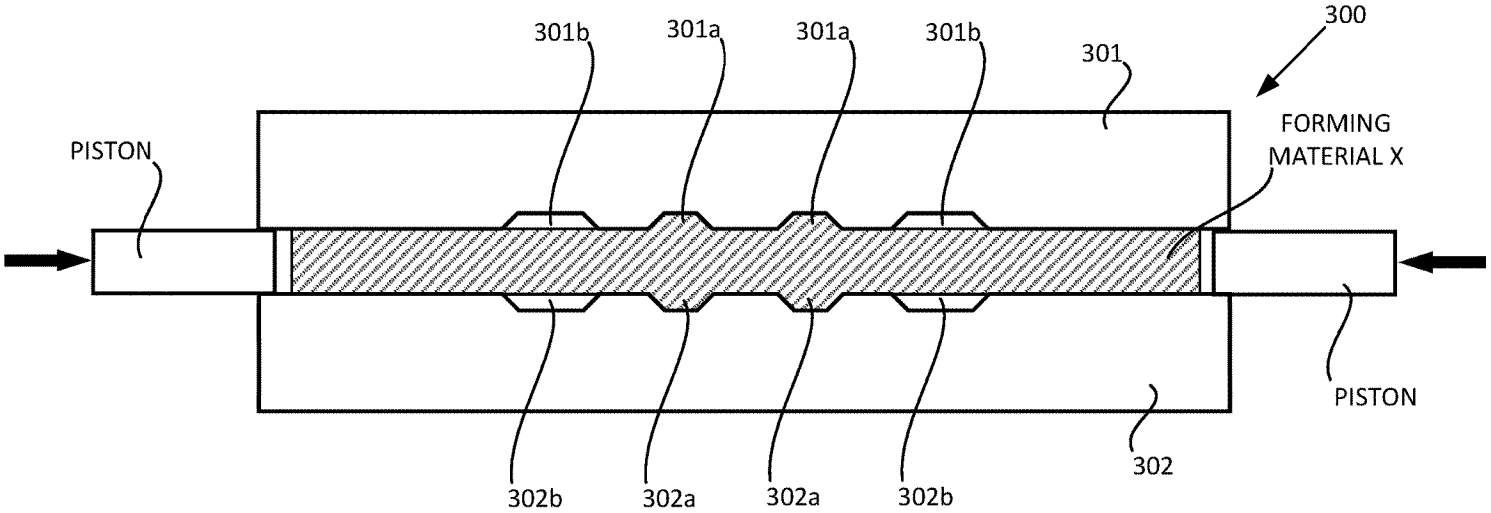
FIGS. 9A and 9B are diagrams showing forming processes of the second large diameter portions by the second mold.

Next, as shown in FIG. 8A, the forming material X having the first large diameter portions 102 formed is placed on the second lower mold 302 of the second mold 300 (step S102). The second upper mold 301 is lowered by a hydraulic cylinder (not shown). Next, as shown in FIG. 8B, the second upper mold 301 is brought into close contact with the forming material X to form a closed state. The second upper mold 301 applies a predetermined load to the forming material X while maintaining this closed state, and at the same time, pressure is applied to the forming material X from both sides in the axial direction of the forming material X by pistons as shown in FIG. 9A.

Due to the pressure from the top and both sides of the forming material X, part of the forming material X flows into the concave portions that constitute the second cavities 301*b* and 302*b* formed in the second upper mold 301 and the second lower mold 302, through extrusion molding, by which the second large diameter portions 103 are formed (step S103).

Figure 9B:
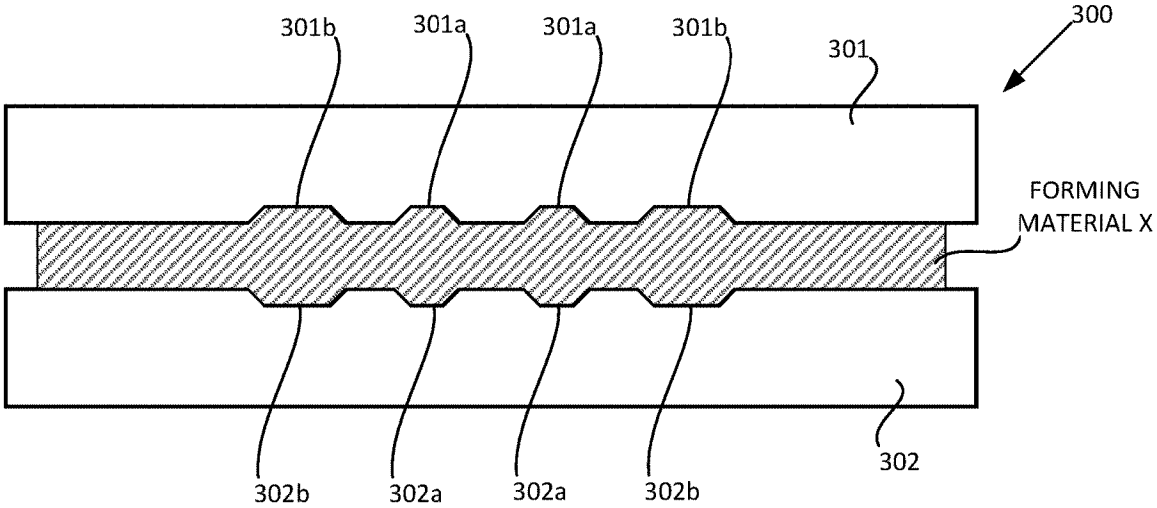

On the other hand, the already formed first large diameter portions 102 are lead to a state of being fitted in the first cavities 301*a* and 302*a* which are formed in the second upper mold 301 and the second lower mold 302, under the closed state shown in FIG. 9B, and without causing further material flow even with the pressure applied to the forming material X from above and from both sides, the shapes of the first large diameter portions 102 can be maintained.

Figure 10A:
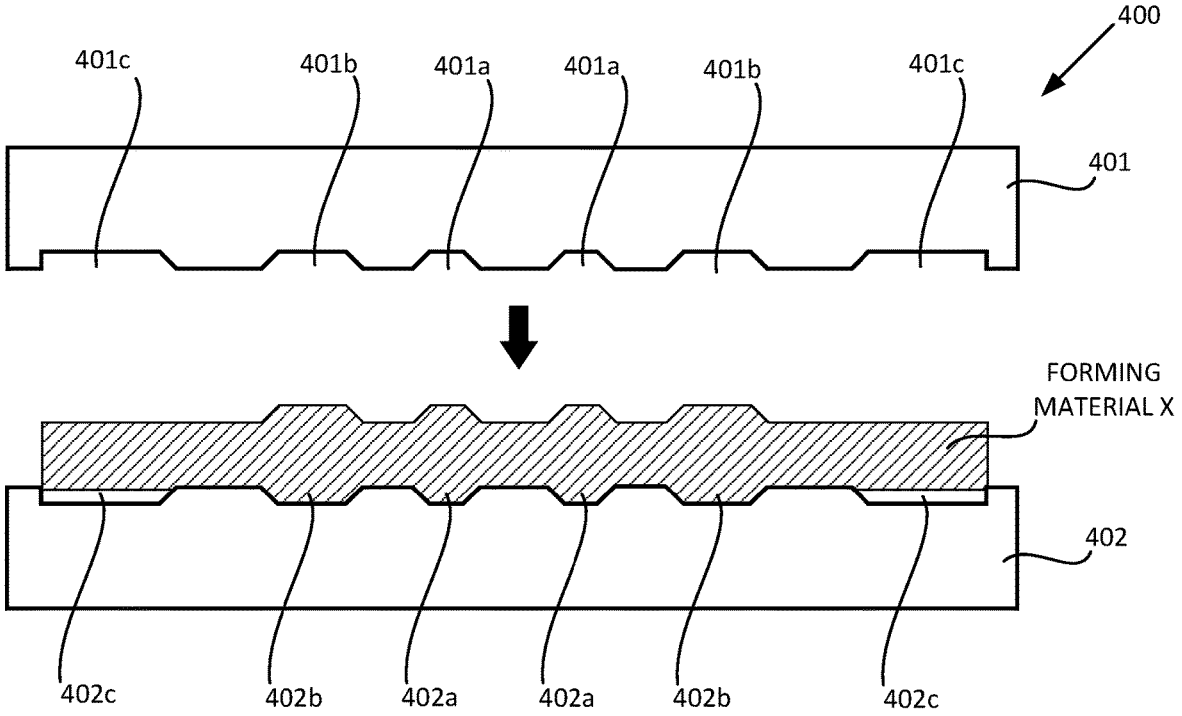
FIGS. 10A and 10B are diagrams showing forming processes of third large diameter portions by the third mold.
Figure 10B:
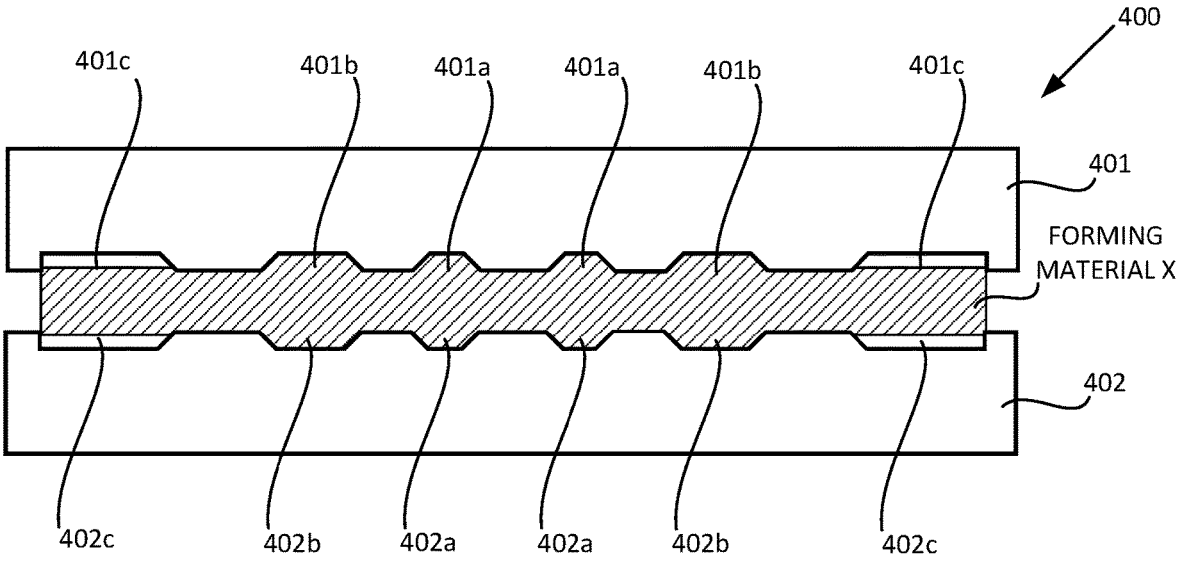
Figure 11A:
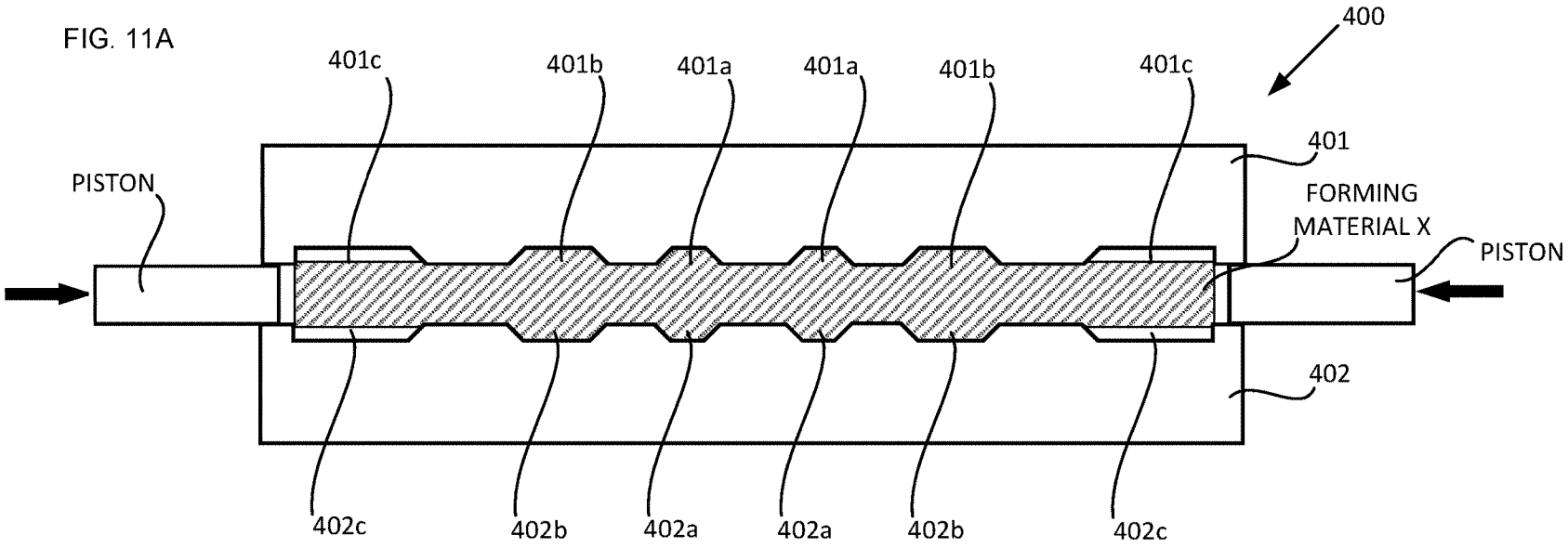
FIGS. 11A and 11B are diagrams showing forming processes of the third large diameter portions by the third mold.
Figure 11B:
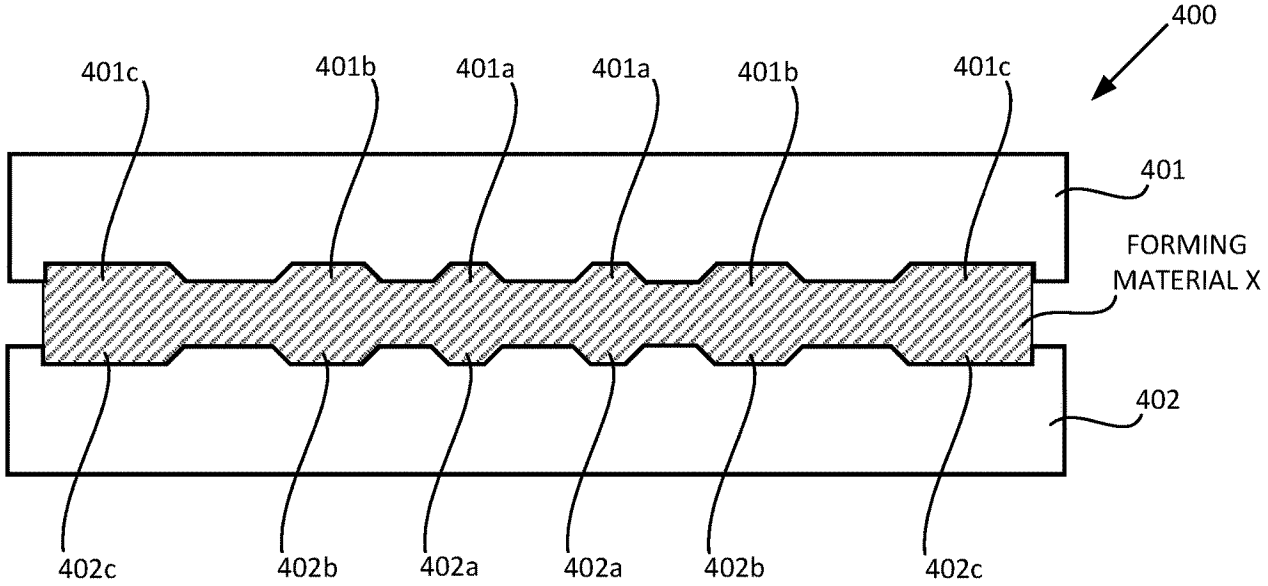

Next, as shown in FIG. 10A, the forming material X with the first large diameter portions 102 and the second large diameter portions 103 being formed is placed on the third lower mold 402 (step S104). Then, the third upper mold 401 is lowered by a hydraulic cylinder (not shown) to bring the third upper mold 401 into close contact with the forming material X to form a closed state as shown in FIG. 10B. While maintaining this closed state, the third upper mold 401 applies a predetermined load to the forming material X from above, and at the same time, as shown in FIG. 11, pressure is applied to the forming material X from both sides in the axial direction of the forming material X by pistons.

Due to the pressure from the top and both sides of the forming material X, part of the forming material X flows into the concave portions that constitute the third cavities 401*c* and 402*c* formed in the third upper mold 401 and the third lower mold 402, through extrusion molding, by which the third large diameter portions 104 are formed (step S104).

On the other hand, when pressure is applied to the forming material X from above and from both sides, the first large diameter portions 102 being formed in the forming material X are lead to a state of being fitted in the first cavities 401*a* and 402*a* which are formed in the third upper mold 401 and the third lower mold 402, whereas the second large diameter portions 103 are lead to a state of being fitted in the second cavities 401*b* and 402*b* which are formed in the third upper mold 401 and the third lower mold 402. Therefore, the first large diameter portions 102 and the second large diameter portions 103 can maintain their respective shapes while no material movement due to pressure can be caused.

As described above, the constant velocity drive shaft 100 is formed through a plurality of processes of closed cold forging, and finally, the constant velocity drive shaft 100 as a product can be manufactured by performing polishing and other necessary processing.

The present invention is not limited to the above-described embodiments, and various modifications are possible without departing from the scope of the present invention.

The invention claimed is:

1. A method for manufacturing a constant velocity drive shaft using a closed cold forging device having a plurality of mold pairs structured with an upper mold and a lower mold, comprising:

a first process for processing a forming material for forming the constant velocity drive shaft to form a first forming material having at least one first large diameter portion by applying a pressure of 2000 kN to 5000 kN from a first upper mold of a first mold pair and pressures of 2000 kN to 3000 kN from both sides in an axial direction of the forming material;

a second process for forming a second forming material having at least one second large diameter portion by applying a pressure from a second upper mold of a second mold pair and pressures from both sides in an axial direction of the first forming material with respect to the first forming material having the at least one first large diameter portion being mold-processed in the first process; and a third process for forming at least one third large diameter portion by applying a pressure from a third upper mold of a third mold pair and pressures from both sides in an axial direction of the second forming material with respect to the second forming material having the at least one first large diameter portion and the at least one second large diameter portion being mold-processed in the second process.

2. The method for manufacturing the constant velocity drive shaft according to claim 1, wherein the first mold pair has at least one first cavity having a concave shape for forming the at least one first large diameter portion, and walls on both sides of the concave shape of the at least one first cavity has a tapered shape.

3. The method for manufacturing the constant velocity drive shaft according to claim 1, wherein the second mold pair has at least one second cavity having a concave shape for forming the at lease one second large diameter portion, and at least one first cavity for maintaining the shape of the at least one first large diameter portion contained in the first forming material, and walls on both sides of the concave shape of the at least one second cavity has a tapered shape.

4. The method for manufacturing the constant velocity drive shaft according to claim 1, wherein the third mold pair has at least one third cavity having a concave shape for forming the at least one third large diameter portion, and at least one first cavity and at least one second cavity for maintaining the shapes of the at least one first large diameter portion and the at least one second large diameter portion contained in the second forming material, and the at least one third cavity has a tapered shape only on one side of the concave shape.

* * * * *